US006929519B2

(12) United States Patent
Ide et al.

(10) Patent No.: US 6,929,519 B2
(45) Date of Patent: Aug. 16, 2005

(54) OUTBOARD MOTOR

(75) Inventors: Shinichi Ide, Wako (JP); Makoto Yazaki, Wako (JP); Mitsuaki Kubota, Wako (JP); Hiroshi Yamamoto, Wako (JP)

(73) Assignee: Honda Motor Co., Ltd., Tokyo (JP)

( * ) Notice: Subject to any disclaimer, the term of this patent is extended or adjusted under 35 U.S.C. 154(b) by 0 days.

(21) Appl. No.: 10/863,893

(22) Filed: Jun. 8, 2004

(65) Prior Publication Data

US 2004/0266283 A1 Dec. 30, 2004

(30) Foreign Application Priority Data

Jun. 25, 2003 (JP) ..... 2003-181613

(51) Int. Cl.[7] ..... B63H 20/32
(52) U.S. Cl. ..... 440/77; 440/88 L
(58) Field of Search ..... 440/76, 77, 88 R, 440/88 L; 123/196 W; 184/1.5, 106; 141/86, 87, 88

(56) References Cited

U.S. PATENT DOCUMENTS 5,501,621 A * 3/1996 Shigedomi et al. ..... 440/52
6,589,086 B2 * 7/2003 Tsubouchi et al. ..... 440/88 L

FOREIGN PATENT DOCUMENTS

JP 2624636 10/1995
JP 01027110 1/2001

* cited by examiner

*Primary Examiner*—Andrew D. Wright
(74) *Attorney, Agent, or Firm*—Adams & Wilks

(57) ABSTRACT

An outboard motor includes an under cover covering a part of an engine, a mount case supporting the engine, and an oil pan provided below the mount case. The under cover has an opening formed at a place opposite to a drain unit provided at a lower portion of the oil pan. The opening can be opened and closed by a drain cover having first and second locks. A release of the first lock is operated to allow the drain cover to be attached and detached to and from the opening with a single motion.

13 Claims, 10 Drawing Sheets

OUTBOARD MOTOR

FIELD OF THE INVENTION

The present invention relates to outboard motors, and more particularly, to outboard motors having a drain cover covering a drain unit provided at a lower portion of an oil pan.

BACKGROUND OF THE INVENTION

An outboard motor with a four-stroke engine generally has an oil pan for retaining lubricating oil. Since lubricating oil in the oil pan needs a periodic change, an oil drain hole is formed in the vicinity of the bottom of the oil pan to allow the lubricating oil to be discharged.

The oil pan is provided within an extension case located below an engine cover. The drain hole in the oil pan is generally blocked by a drain plug. A change of oil is done with the drain plug removed.

An outboard drain structure of this kind is disclosed, for example, in Japanese Patent No. 2624636 or in Japanese Patent Laid-Open Publication No. 2001-27110.

An outboard drain structure disclosed in Japanese Patent No. 2624636 is configured such that a recess is formed in a portion of a metal extension case made from an aluminum alloy, a drain plug faces onto the recess, and a drain cover of C-shaped cross section closes the recess. The drain cover is attached to the extension case with a set screw.

When draining an oil pan, first, the drain cover is removed from the recess. Then, the drain cover is oriented horizontally, and the proximal portion of the drain cover is hooked on a stopper provided in the recess. At that time, the drain cover opens upward to serve as a gutter. Next, the drain plug is removed from the oil pan to discharge oil outside via the gutter-like drain cover.

Since the drain structure is configured such that the drain cover is attached to the extension cover with the set screw, it is necessary to screw the drain cover using a tool, resulting in time-taking fastening and removing operations of the drain cover.

A drain structure disclosed in Japanese Patent Laid-Open Publication No. 2001-27110 is configured such that a drain plug of an oil pan is provided opposite to an opening formed in an engine cover.

The drain plug in this drain structure is exposed outside and is likely to show a stain of seawater.

It is thus desired to improve workability when changing oil without exposing a drain plug outside.

SUMMARY OF THE INVENTION

According to the present invention, there is provided an outboard motor which comprises an engine supported on a mount case; an oil pan provided below the mount case and having a drain unit at a lower portion thereof; an under cover made from resin, covering a part of the engine, the mount case and the oil pan, the under cover having an opening formed opposite to the drain unit; and a drain cover made from resin for removably covering the opening, the drain cover having two locks to be engaged and disengaged with and from the under cover.

As described above, the drain cover closes the opening, preventing the drain and the surrounding portion from being exposed. The opening through which the drain unit is exposed is formed in the resin undercover, and the resin drain cover having the locks removably closes the opening. That is, the drain cover can be engaged and disengaged with and from the opening via the locks with a single motion. This eliminates the need for using a set screw or the like to mount the drain cover to the opening of the under cover, enabling single-motion mounting and removal without using an extra tool, and improving workability when changing oil.

Preferably, the under cover has a side wall and a front wall; and the drain cover comprises a plate member of substantially L-shaped cross section to fit to the opening formed in the side wall and the front wall. When mounting or removing the drain cover to or from the opening, the drain cover which is a plate member of substantially L-shaped cross section can be easily held, facilitating the mounting and removing operations by hand. The two locks are at 90° different locations while the flat drain cover closes the opening, resulting in stable lock.

The drain cover preferably has a side portion to be substantially flush with the side wall of the under cover and at least two guide plates spaced and set upright on an inner surface of the side portion. The drain cover when covering the drain unit is continuously flush with the under cover, resulting in good appearance. The two guide plates provided on the inner surface of the drain cover serve as a gutter member when draining oil, constituting a guide member when draining oil.

The drain cover is turned over to turn an inner surface thereof upward, and one of the locks is engaged with the drain unit to hold the drain cover on the drain unit. That is, when discharging oil, all that is needed is to hook a U-shaped lock of the drain cover on the drain unit, so that the drain cover can be used as an oil drain guide member.

BRIEF DESCRIPTION OF THE DRAWINGS

Preferred embodiments of the present invention will be described in detail below, by way of example only, with reference to the accompanying drawings, in which.

DETAILED DESCRIPTION OF THE PREFERRED EMBODIMENTS

Figure 1:
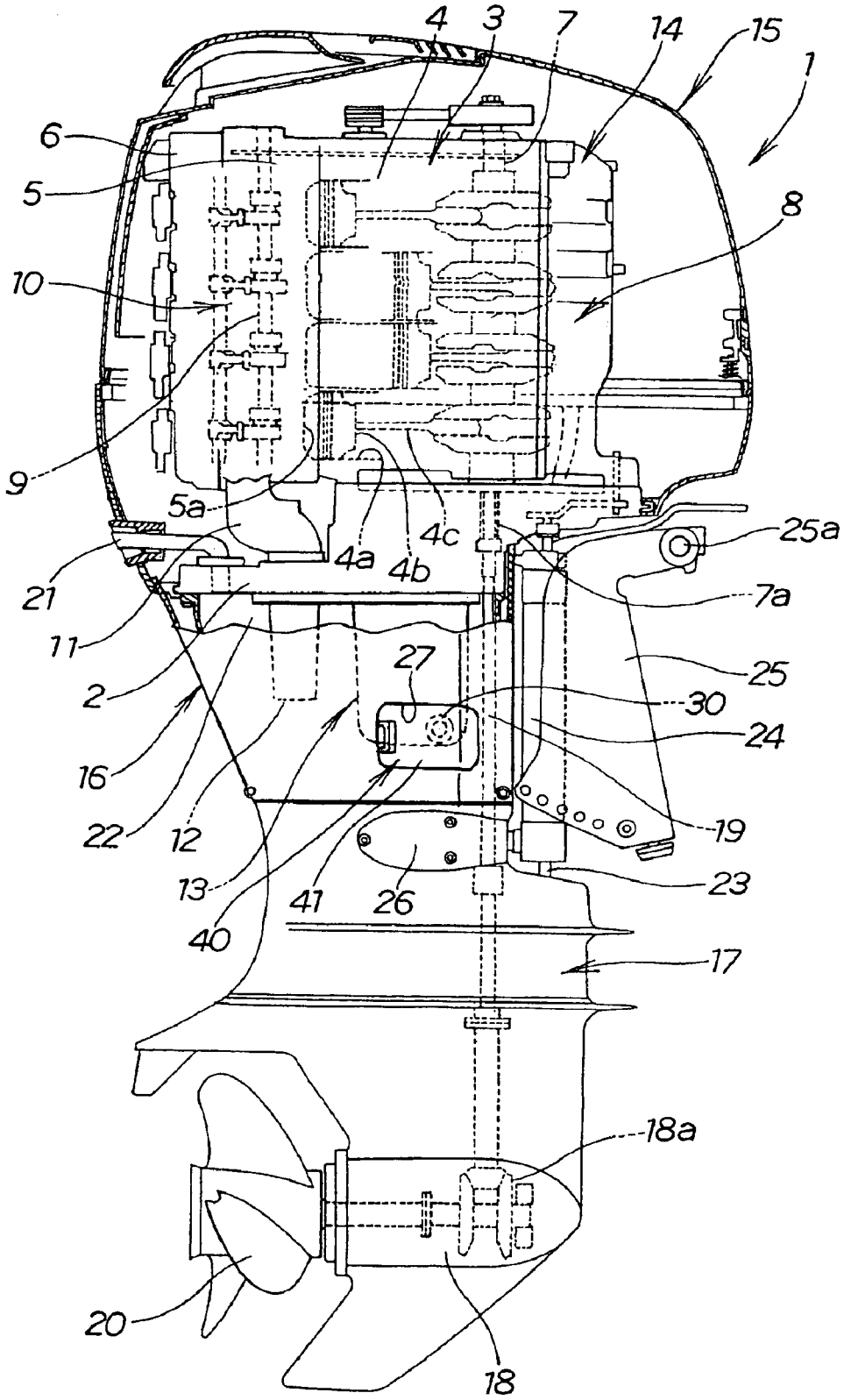
FIG. 1 is a cutaway view of an outboard motor according to the present invention.

Referring to FIG. 1, an outboard motor 1 includes a mount case 2 supporting an engine 3. The engine 3 has a cylinder block 4, a cylinder head 5 located rearward of the cylinder block 4, and a cylinder head cover 6 provided rearward of the cylinder head 5.

The engine 3 is a multicylinder (four-cylinder in the illustrated example) engine having a plurality of horizontal cylinders 4*a* disposed vertically one atop another.

Pistons 4*b* reciprocate within the respective cylinders 4*a*. The cylinder head 5 has combustion chambers 5*a* corresponding to the respective cylinders 4*a*.

Each piston 4*b* is coupled to a crankshaft 7 disposed in a vertical position via a connecting rod 4*c*. A crankcase 14 is provided at the front of the cylinder block 4. The crankshaft 7 is housed in the crankcase 14 in the vertical position. The crankcase 14 defines a crank chamber 8.

The cylinder head 5 and the cylinder head cover 6 form a cam chamber 10 vertically housing a camshaft 9 in parallel with the crankshaft 7.

An exhaust manifold 11 communicating with the combustion chambers 5*a* in the cylinder head 5 is connected to an exhaust pipe 12 extending vertically through the mount case 2 in a communicating manner.

An oil pan 13 is provided below the mount case 2 in a vertically extending manner. A drain unit 30 through which oil is discharged when changing oil is provided at a lower lateral surface of the oil pan 13.

The engine 3, mount case 2 and oil pan 13 are covered by a resin cover. The cover consists of an engine cover 15 covering a main part of the engine 3, and an under cover 16 covering a lower part of the engine 3 and the oil pan 13.

The under cover 16 constitutes a fixed cover body covering the mount case 2 and the oil pan 13.

A metal extension case 17 made from an aluminum alloy is connected to the bottom of the under cover 16. A gear box 18 is provided at the bottom of the extension case 17.

An output shaft 7*a* at the lower end of the crankshaft 7 is connected to a drive shaft 19 extending vertically through the under cover 16 and the extension case 17.

The drive from the engine 3 rotates a propeller 20 of the outboard motor 1 via the crankshaft 7, drive shaft 19 and a gear mechanism 18*a* in the gear box 18.

An exhaust gas resulting from the operation of the engine 3 is normally discharged into water through the exhaust pipe 12. However, when the engine 3 has a small exhaust pressure, running at a low speed, an exhaust gas within an exhaust expansion chamber 22 defined by the mount case 2 is discharged through a sub-exhaust pipe 21 to the atmosphere.

A swivel shaft 23 extends vertically through a swivel case 24 of a stern bracket 25, supporting the outboard motor 1 in a steerable manner. The stern bracket 25 has a tilt shaft 25*a*, supporting the outboard motor 1 in a tiltable manner with respect to a hull (not shown).

The under cover 16 as a fixed cover body has an opening 27 formed at a position opposite to the drain unit 30 of the oil pan 13.

Figure 2:
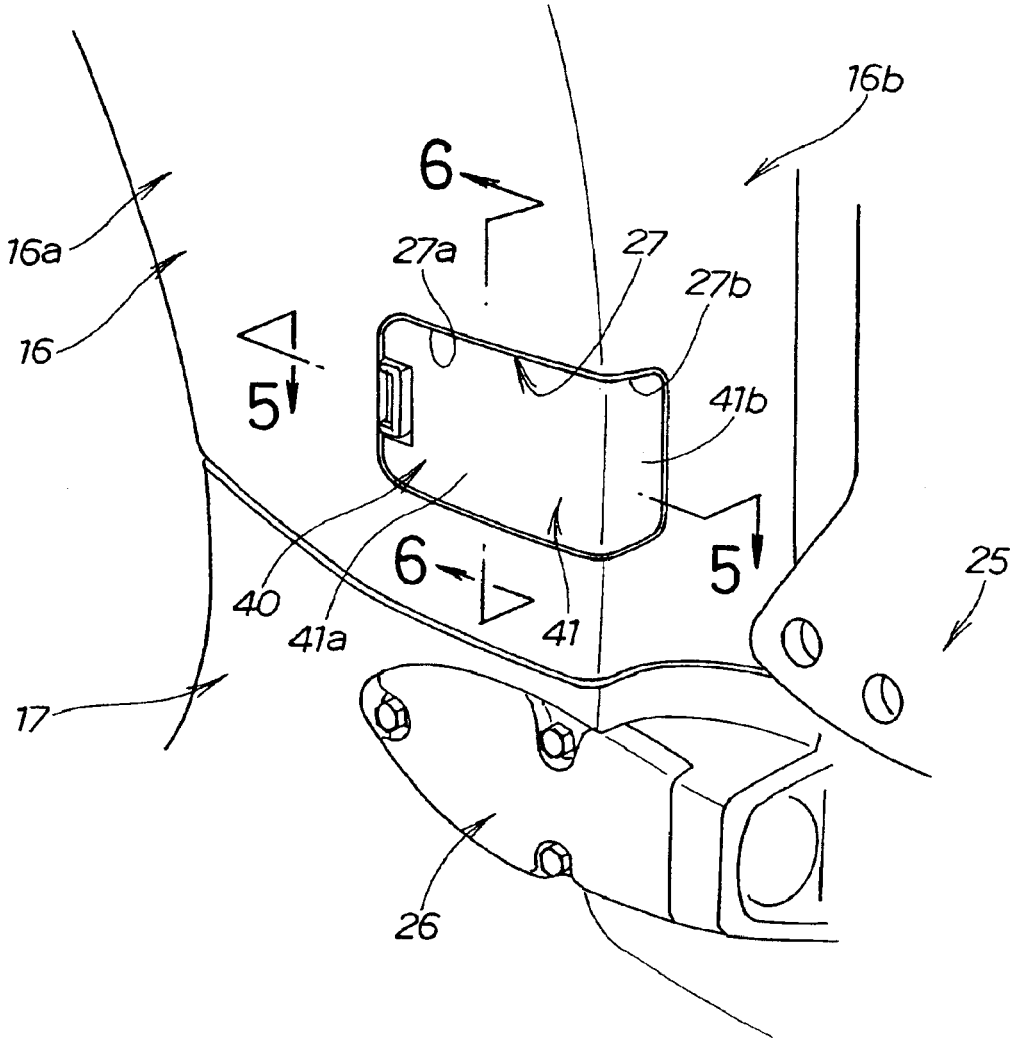
FIG. 2 is a perspective view illustrating a state where an opening formed in an under cover is closed by a drain cover.

As shown in FIG. 2, the opening 27 has an L-shaped cross section horizontally elongated from a side wall 16*a* to a front wall 16*b* of the under cover 16, formed by side upper and lower edges 27*a* of the side wall 16*a* and front upper and lower edges 27*b* of the front wall 16*b*. The opening 27 is closed by a drain cover 40 as a cover member. The drain cover 40 is made from synthetic resin, and is removably mounted to the opening 27.

In FIG. 2, reference numeral 26 denotes a bracket supporting a lower portion of the swivel case (see FIG. 1) on the extension case 17.

Figure 3:
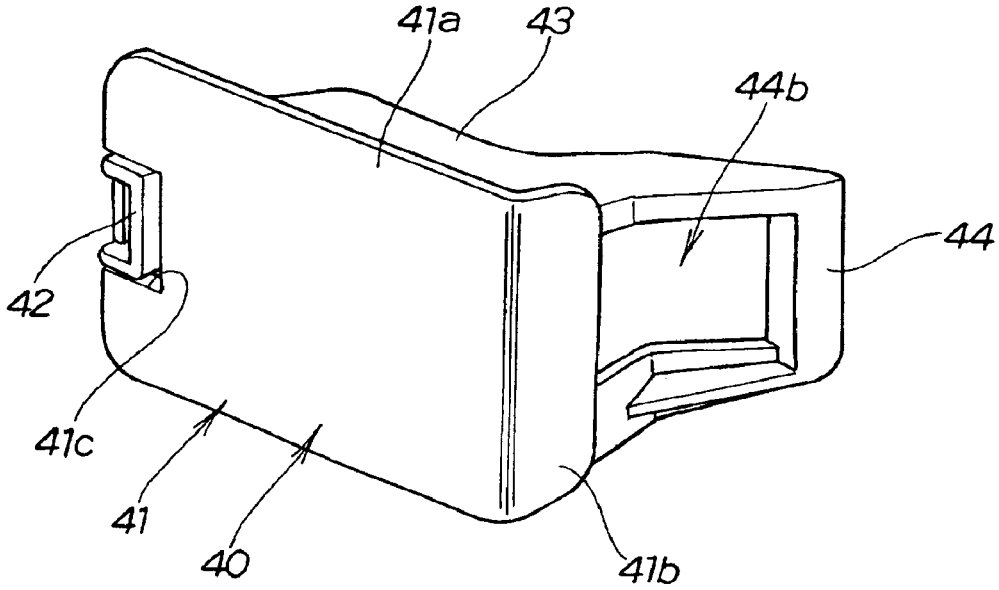
FIG. 3 is a perspective view of the drain cover viewed from the outside.
Figure 4:
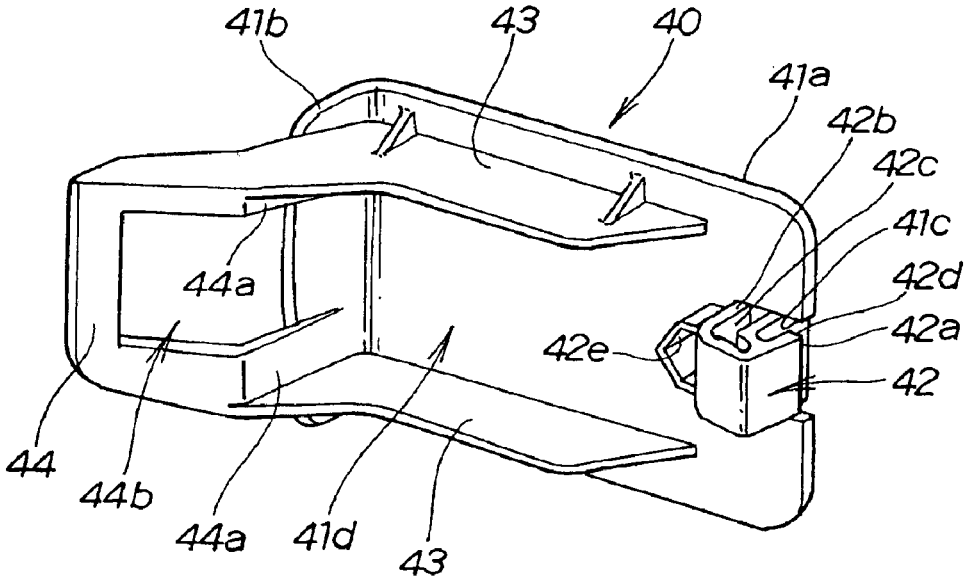
FIG. 4 is a perspective view of the drain cover viewed from the inside.

The drain cover 40 is shown in detail in FIGS. 3 and 4.

The drain cover 40 has a cover body 41 of L-shaped cross section for substantially closing the opening 27 shown in FIG. 2. The cover body 41 consists of a side portion 41*a* and a front portion 41*b* bent from the front end. A U-shaped notch 41*c* is formed in a vertically middle and longitudinally rear end portion of the side portion 41*a*. The notch 41*c* is provided with a first lock 42 integrally formed with the side portion 41*a*.

The first lock 42 is made from resin like the drain cover 41 and there has elasticity. As shown in FIG. 4, the first lock 42 has a lock release 42*a*, a connected portion 42*b* continuous with the inner end of the U-shaped notch 41*c*, a reinforcing rib 42*e* provided on an inner surface 41d of the side portion 41*a* in front of the connected portion 42*b*, and a U-shaped gap 42*c* formed between the lock release 42*a* and the connected portion 42*b*. The lock release 42*a* has an engaging step 42*d* with a clearance between the lock release 42*a* and the engaging step 42*d*.

The lock release 42*a* elastically bends toward the connected portion 42*b*, narrowing the gap 42*c* and elastically deforming toward the front of the opening 27 shown in FIG. 2 so as to disengacre the engaciinci steD 42*d* from the side wall 16*a* of the under cover 16.

Two guide plates are provided on the inner surface 41*d* of the side portion 41*a* of the cover body 41. Specifically, two guide plates 43, 43 are provided longitudinally of the side portion 41*a* in such a manner as to be spaced vertically (in the direction of the narrower width of the side portion 41*a*) and set upright in parallel. Front end portions of the two guide plates 43, 43 protrude, on the inside of the front portion 41*b*, inward of the opening 27 shown in FIG. 2 to a given height. The amount of protrusion is greater than the height of the front portion 41*b*. The protruding end portions of the guide plates 43, 43 are united with a U-shaped second lock 44. The second lock 44 has a space 44*b*. Proximal portions 44*a*, 44*a* of the second lock 44 are integrally connected to the inner surface of the front portion 41*b*.

Now, the mounting of the drain cover 40 to the under cover 16 will be described with reference to FIGS. 5 and 6.

Figure 5:
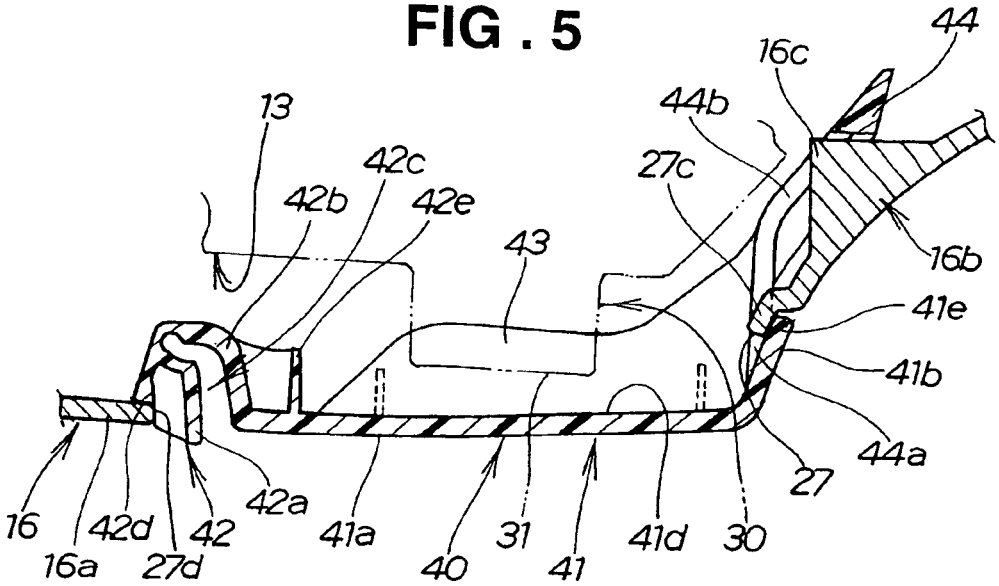
FIG. 5 is a cross-sectional view taken along line 5—5 in FIG. 2.

As shown in FIG. 5, the two guide plates 43, 43 set upright on the inner surface of the drain cover 40 and the second lock 44 are housed in the under cover 16 via the opening 27.

An edge portion 41*e* of the front portion 41*b* of the cover body 41 engages a ledge 27*c* formed at a front end portion of the opening 27 to be supported thereon. The first lock 42 formed at the rear end of the cover body 41 is located at a rear end portion 27*d* of the opening 27. The engaging step 42*d* of the lock release 42*a* engages an inner edge portion of the rear end portion 27*d* of the opening 27. At that time, the lock release 42*a* is elastically deformed in the direction of narrowing the gap 42*c*.

The second lock 44 of the drain cover 40 engages an engaging rib 16*c* formed at the inside of the front wall 16*b* of the under cover 16.

Figure 6:
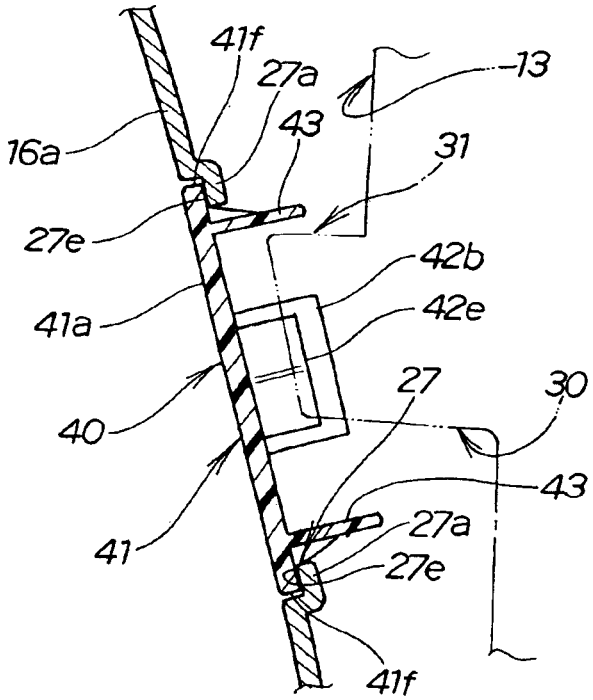
FIG. 6 is a cross-sectional view taken along line 6—6 in FIG. 2.

As shown in FIG. 6, upper and lower edges 41*f*, 41*f* of the cover body 41 engage external surfaces of ledges 27*e*, 27*e* formed at the upper and lower edges 27*a*, 27*a* of the opening 27 in an abutting manner. The two guide plates 43, 43 protrude inward of the opening 27. FIGS. 2, 5, and 6 show the drain cover 40 in a first orientation in which the drain cover 40 is releasably engaged with the under cover 16 and covers the opening 27.

Figure 7:
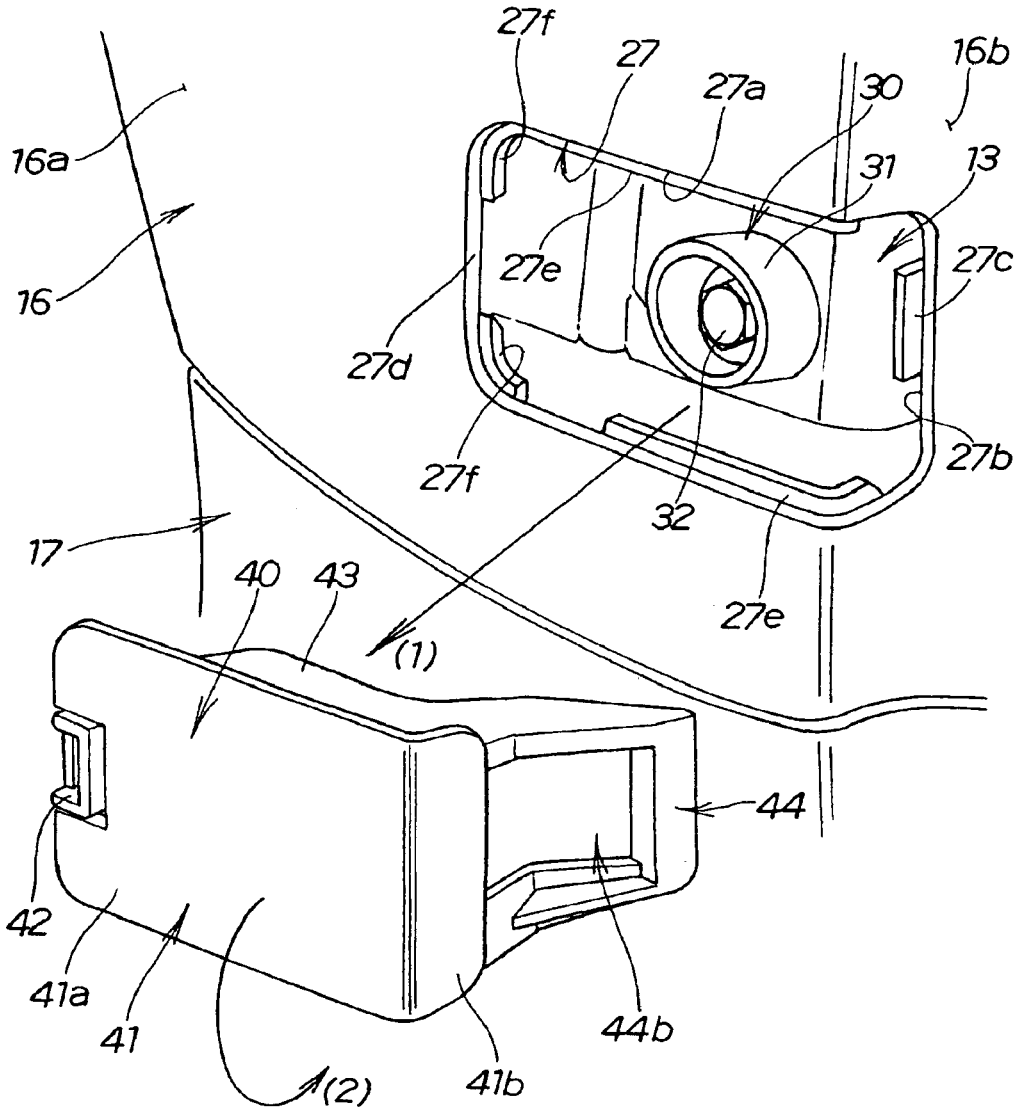
FIG. 7 is a perspective view illustrating a state where the drain cover is removed from the opening of the under cover.

FIG. 7 shows the drain cover 40 removed from the opening 27 of the under cover 16.

Figure 10:
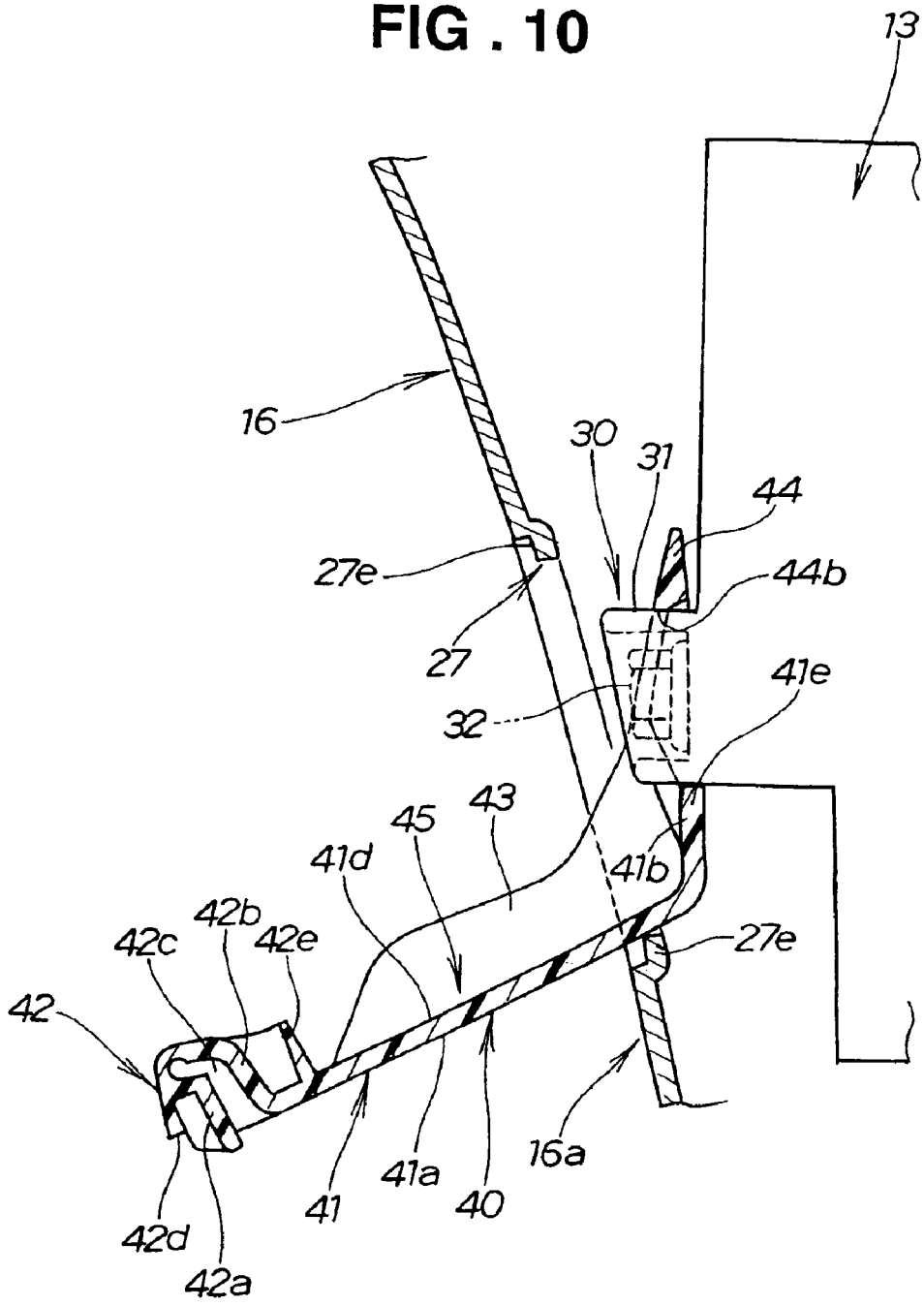
FIG. 10 is a cross-sectional view taken along line 10—10 in FIG. 9.

The drain unit 30 provided at a lower side portion of the oil pan 13 consists of a cylindrical outlet pipe 31 of a short length for guiding oil in the oil pan 13 outside when draining it and a drain plug 32 disposed within the outlet pipe 31. As shown in FIG. 10, the amount of protrusion of the outlet pipe 31 is larger at an upper portion and smaller at a lower portion.

The opening 27 also has ledges 27*f*, 27*f* at rear upper and lower corners of the opening 27 as well as having the ledges 27*c*, 27*e*, 27*e* at the front portion and the upper and lower portions, respectively.

Figure 8:
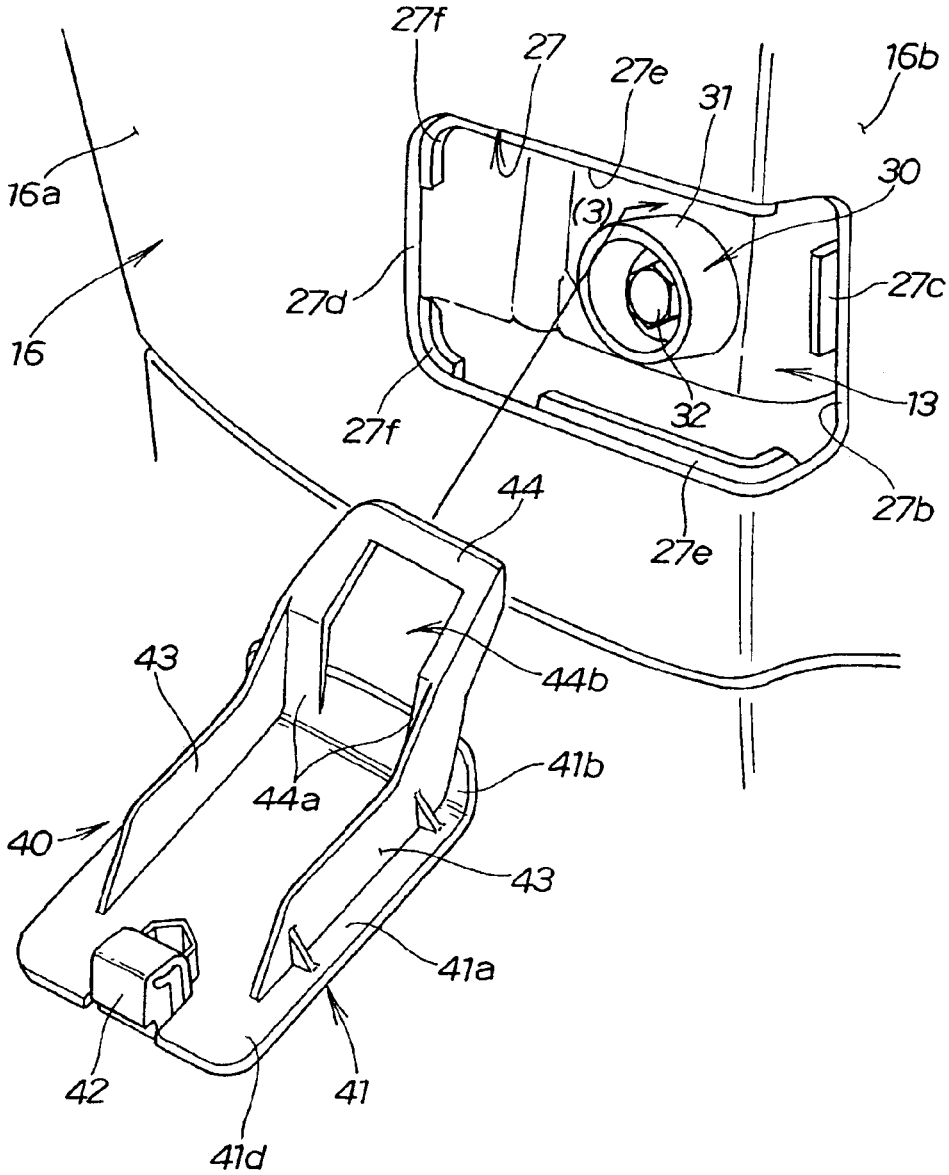
FIG. 8 is a perspective view of the drain cover removed from the opening of the under cover and turned over.

FIG. 8 shows the drain cover 40 turned over after removed from the opening 27 of the under cover 16.

The drain cover 40 is removed from the opening 27 as shown by arrow (1) in FIG. 7, and then the drain cover 40 removed is turned over as shown by arrow (2). As a result, as shown in FIG. 8, the inner surface 41*d* of the drain cover 40 is turned upward and the guide plates 43, 43 and the U-shaped second lock 44 are turned upward.

With this state, the drain cover 40 is inserted as shown by arrow (3) such that the second lock 44 surrounds the outlet pipe 31 of the drain unit 30, thereby to insert the outlet pipe 31 into the space 44*b* in the second lock 44.

Figure 9:
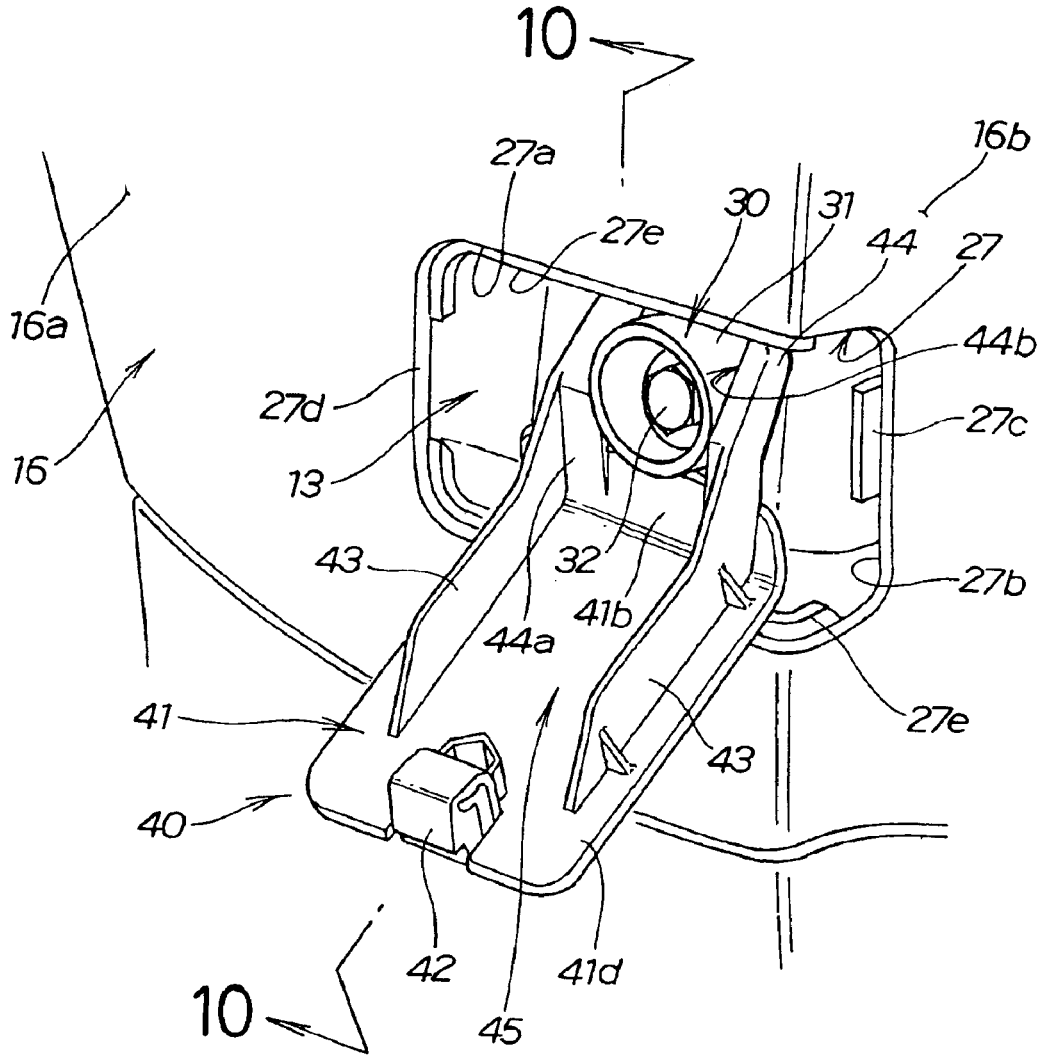
FIG. 9 is a perspective view of the drain cover turned over and engaged with a drain unit.

As shown in FIGS. 9 and 10, the second lock 44 enters the opening 27 and engages the outlet pipe 31 of the drain unit 30. The drain cover 40 is thus held on the drain unit 30 within the opening 27 with the inner surface 41*d* facing upward. Specifically, as shown in FIG. 10, the second lock 44 is hooked on the top surface of the outlet pipe 31, and the edge portion 41*e* of the front portion 41*b* of the cover body 41 abuts against the bottom surface of the outlet pipe 31.

The side portion 41*a* of the cover body 41 is supported on the lower ledge 27*e* of the opening 27, and the drain cover 40 is held with the distal end (including the first lock 42) of the cover body 41 inclined downward.

With the drain cover 40 held on the drain unit 30, the outlet pipe 31 of the drain unit 30 protrudes from the second lock 44 toward the two guide plates 43, 43 by a given amount. As shown in FIG. 9, the two guide plates 43, 43 are higher at the side of the front portion 41 of the cover body 41 located near the drain unit 30 and lower at the side of the second lock 42, thereby forming an oil drain guide path 45. FIGS. 9 and 10 show the drain cover 40 in a second orientation in which the drain cover 40 is releasably engaged with the drain unit 30.

As described above, after the drain cover 40 is removed from the opening 27, the second lock 44 is inserted into the opening 27, and the second lock 44 is hooked on the outlet pipe 31 of the drain unit 30, thereby to engage the drain cover 40 with the drain unit 30. Then, the drain plug 32 is removed to discharge oil in the oil pan 13 through the drain hole.

The oil discharged through the drain hole runs down the drain guide path 45 of a gutter shape formed by the two guide plates 43, 43 of the drain cover 40 to be discharged outside. The discharged oil is thus prevented from spilling laterally by the two guide plates 43, 43 and thus prevented from making the area around it dirty. The oil discharged along the drain guide path 45 is received by an oil receiver.

Now, the method of removing the drain cover 40 mounted to the opening 27 of the under cover 16 will be described with reference to FIGS. 11A, 11B and 11C.

Figure 11A:
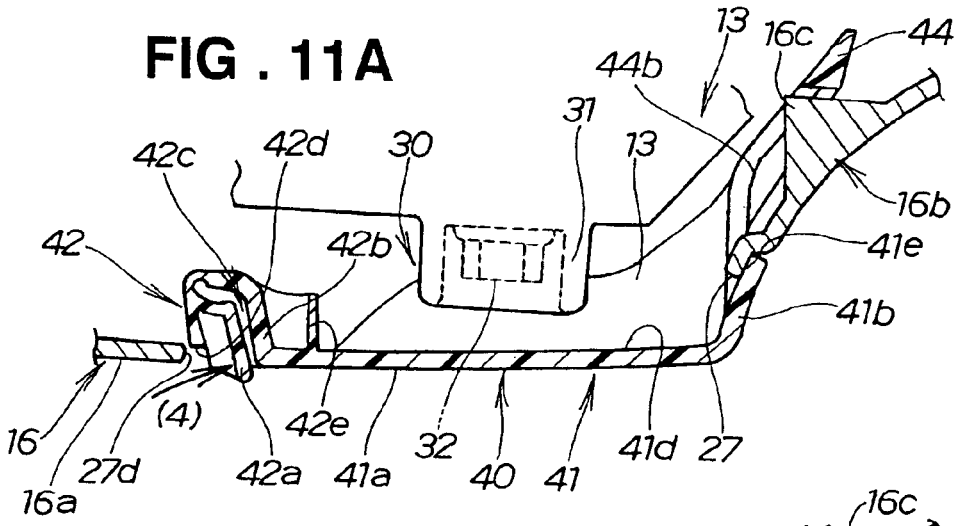
FIGS. 11A, 11B and 11C are cross-sectional views illustrating how to remove the drain cover from the opening of the under cover.

As shown in FIG. 11A in which the drain cover 40 is shown in its first orientation, first, the lock release 42*a* of the first lock 42 is pressed and deformed toward the gap 42*c* as shown by arrow (4). The deformation causes the engaging step 42*d* to be disengaged from the end portion 27*d* of the opening 27.

Figure 11B:
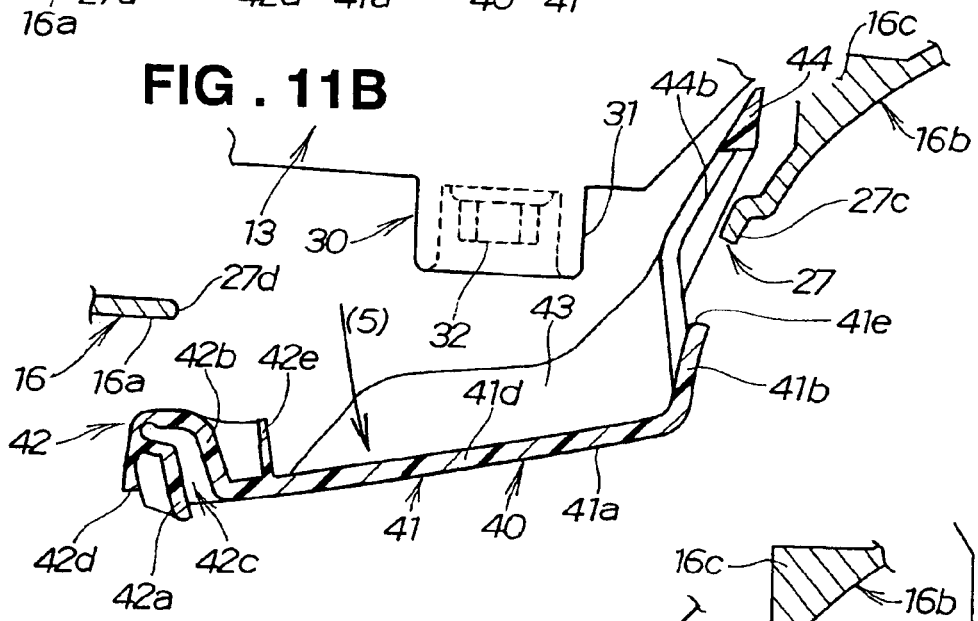

Next, as shown in FIG. 11B, the first lock 42 is extracted from the opening 27 in the direction of arrow (5) to the outside. At that time, the edge portion 41*e* of the front portion 41*b* of the cover body 41 is disengaged from the ledge 27*c* of the opening 27. At the same time, the second lock 44 is disengaged from the rib 16*c* of the under cover 16.

Figure 11C:
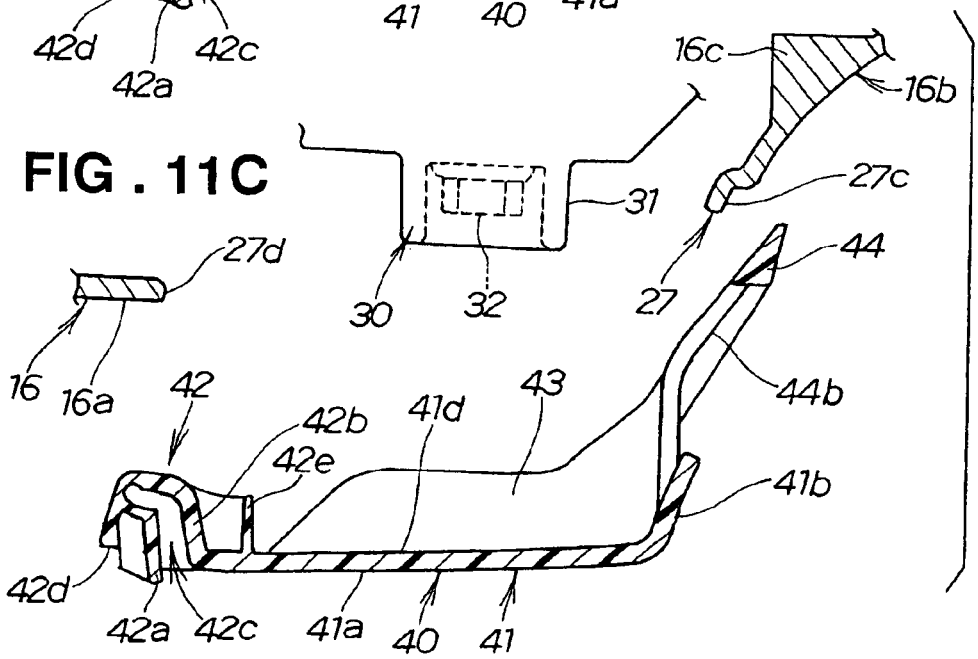

Finally, as shown in FIG. 11C, the drain cover 40 is detached from the opening 27.

The mounting of the drain cover 40 to the opening 27 can be done in the reverse order to that of the above-described operation.

Now, the method of hooking the drain cover 40 removed from the opening 27 on the drain unit 30 to drain the oil pan 13 will be described with reference to FIGS. 12A, 12B and 12C.

Figure 12A:
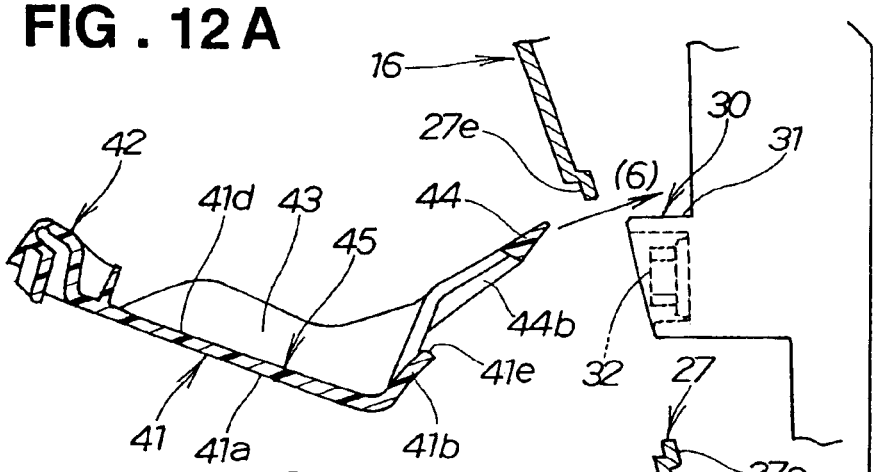
FIGS. 12A, 12B and 12C are cross-sectional views illustrating how to mount the drain cover when discharging oil.

First, as shown in FIG. 12A, the drain cover 40 is turned over in position to turn the inner surface 41*d* of the cover body 41 upward, and the second lock 44 is inserted into the opening 27 as shown by arrow (6).

Figure 12B:
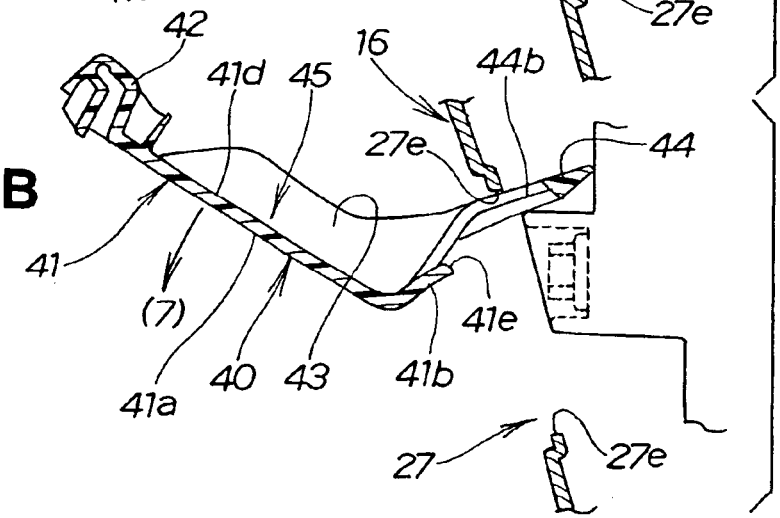

Then, as shown in FIG. 12B, the space 44*b* in the second lock 44 is opposed to the outlet pipe 31 of the drain unit 30, and then the side of the first lock 42 of the drain cover 40 is moved downward as shown by arrow (7).

Figure 12C:
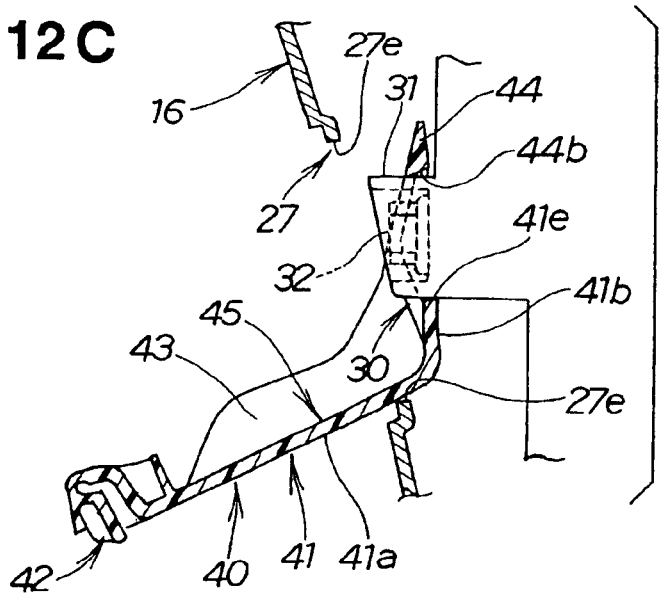

As a result, as shown in FIG. 12C, the drain cover 40 is placed in its second orientation in which the second lock 44 is engaged with the outlet pipe 31 of the drain unit 30, and the drain cover 40 is hooked and supported on the outlet pipe 31. Thereafter the drain plug 32 is removed to drain the oil pan 13.

Obviously, various minor changes and modifications of the present invention are possible in the light of the above teaching. It is therefore to be understood that within the scope of the appended claims the invention may be practiced otherwise than as specifically described.

What is claimed is:

1. An outboard motor comprising:

an engine supported on a mount case;

an oil pan provided below the mount case and having a drain unit at a lower portion thereof;

an under cover made from resin and covering a part of the engine, the mount case and the oil pan, the under cover having an opening formed opposite to the drain unit and having a side wall and a front wall in which is formed the opening; and a drain cover made from resin for removably covering the opening, the drain cover having two locks to be engaged and disengaged with and from the under cover, the drain cover comprising a plate member of substantially L-shaped cross section configured to fit to the opening formed in the side wall and the front wall.

2. An outboard motor as set forth in claim 1; wherein the drain cover has a side portion substantially flush with the side wall of the under cover and at least two guide plates spaced and set upright on an inner surface of the side portion.

3. An outboard motor comprising:

an engine supported on a mount case;

an oil pan provided below the mount case and having a drain unit at a lower portion thereof;

an under cover made from resin and covering a part of the engine, the mount case and the oil pan, the under cover having an opening formed opposite to the drain unit; and a drain cover made from resin for removably covering the opening, the drain cover having two locks to be engaged and disengaged with and from the under cover and being configured such that when the drain cover is turned over to turn an inner surface thereof upward, one of the locks is engageable with the drain unit to hold the rain cover on the drain unit.

4. An outboard motor comprising: an engine supported on a mount case; an oil pan disposed below the mount case and having a drain unit at a lower portion thereof for draining oil from the oil pan; an under cover covering a part of the engine, the mount case and the oil pan, the under cover having an opening disposed opposite to the drain unit to enable access to the drain unit; and a drain cover releasably engageable with the under cover when in a first orientation to cover the opening and being insertable through the opening to releasably engage with the drain unit when in a second orientation to serve as a drain guide path for oil drained from the oil pan by the drain unit.

5. An outboard motor according to claim 4; wherein the drain cover has a first lock for releasably locking the drain cover to the under cover and a second lock for releasably locking the drain cover to the drain unit.

6. An outboard motor according to claim 5; wherein the first lock comprises an engaging step portion releasably engageable with the under cover when the drain cover is in the first orientation, and an elastic lock release portion connected to the engaging step portion for movement therewith and being elastically deformable to disengage the engaging step portion from the under cover.

7. An outboard motor according to claim 6; wherein the second lock is provided on an inner surface of the drain cover and has an opening therein for releasably engaging with the drain unit when the drain cover is in the second orientation.

8. An outboard motor according to claim 5; wherein the second lock is provided on an inner surface of the drain cover and has an opening therein for releasably engaging with the drain unit when the drain cover is in the second orientation.

9. An outboard motor according to claim 5; wherein the drain cover including the first and second locks is made of resin.

10. An outboard motor according to claim 4; wherein the under cover has interconnected side and front walls in which is formed the opening, and the drain cover lies flush with the side and front walls to cover the opening when in the first orientation.

11. An outboard motor according to claim 4; wherein the drain cover has inner and outer surfaces, and when the drain cover is in the first orientation the outer surface faces outwardly, and when the drain cover is in the second orientation the inner surface faces upwardly.

12. An outboard motor according to claim 11; wherein the inner surface of the drain cover has two spaced-apart guide plates that define the drain guide path.

13. An outboard motor according to claim 4; wherein the under cover and the drain cover are made of resin.

* * * * *